US010682550B2

(12) United States Patent
Monak

(10) Patent No.: US 10,682,550 B2
(45) Date of Patent: Jun. 16, 2020

(54) PHYSICAL THERAPY ASSISTANCE DEVICE

(71) Applicant: Stanislau Monak, Jamesburg, NJ (US)

(72) Inventor: Stanislau Monak, Jamesburg, NJ (US)

( * ) Notice: Subject to any disclaimer, the term of this patent is extended or adjusted under 35 U.S.C. 154(b) by 138 days.

(21) Appl. No.: 16/015,676

(22) Filed: Jun. 22, 2018

(65) Prior Publication Data

US 2019/0060712 A1 Feb. 28, 2019

Related U.S. Application Data

(60) Provisional application No. 62/549,341, filed on Aug. 23, 2017.

(51) Int. Cl.

| | |
|---|---|
| ***A63B 26/00*** | (2006.01) |
| ***A63B 21/05*** | (2006.01) |
| ***A63B 21/02*** | (2006.01) |
| ***A63B 21/00*** | (2006.01) |
| ***A63B 71/00*** | (2006.01) |
| ***A63B 22/00*** | (2006.01) |

(52) U.S. Cl.

CPC ..... *A63B 26/003* (2013.01); *A63B 21/023* (2013.01); *A63B 21/05* (2013.01); *A63B 21/4034* (2015.10); *A63B 21/4035* (2015.10); *A63B 22/00* (2013.01); *A63B 2022/0094* (2013.01); *A63B 2071/009* (2013.01)

(58) Field of Classification Search

CPC ..... A63B 26/003; A63B 21/4035; A63B 21/4034; A63B 21/023; A63B 21/05; A63B 22/00; A63B 2071/009; A63B 2022/0094; A63B 21/025

USPC ..... 116/63 C

See application file for complete search history.

(56) References Cited

U.S. PATENT DOCUMENTS 2,022,002 A * 11/1935 Jacks ..... A63B 21/0552 482/122
2,085,161 A * 6/1937 Kraus ..... A63B 69/208 482/90
2,106,994 A * 2/1938 Chapman ..... A63B 21/05 482/126
2,132,862 A * 10/1938 Pilates ..... A63B 21/02 482/122
2,494,094 A * 1/1950 Horstman ..... A63B 23/0211 482/128
3,003,764 A * 10/1961 Yovanovitch ..... A63B 23/16 482/49
3,228,392 A * 1/1966 Speyer ..... A61H 23/0218 601/108
3,317,168 A * 5/1967 Ziph ..... E04H 12/2223 248/156
4,211,404 A * 7/1980 Blowsky ..... A63B 21/00043 482/128

(Continued)

*Primary Examiner* — Nyca T Nguyen
(74) *Attorney, Agent, or Firm* — Peter D. Sleman

(57) ABSTRACT

A physical therapy assistance device includes a base having a non-slip portion, a spring extending between a first end and a second end and having a first height in a fully expanded condition and a partially compressed condition, the spring being coupled to the base at the first end, and a cone extending between a first end having a first diameter, and a second end having a second diameter, the cone having a cone height, and at least partially housing the spring therein so that in the fully expanded condition of the spring, the first height of the spring is larger than the cone height.

10 Claims, 4 Drawing Sheets

(56) References Cited

U.S. PATENT DOCUMENTS 4,830,365 A * 5/1989 March ..... A63B 21/04 482/129
4,842,273 A * 6/1989 Schmeiss ..... A63B 21/05 482/126
4,911,437 A * 3/1990 Schulkin ..... A63B 21/05 482/124
5,052,683 A * 10/1991 Wang ..... A63B 69/34 273/458
5,186,119 A * 2/1993 Hlavin ..... A63C 19/062 116/201
5,391,134 A * 2/1995 Heatwole ..... A63B 21/0004 482/123
5,488,792 A * 2/1996 Kwok ..... B60Q 7/00 116/63 C
5,558,243 A * 9/1996 Chu ..... B65D 81/2038 215/228
5,951,414 A * 9/1999 Sowards ..... A63B 69/0091 473/423
7,228,813 B2 * 6/2007 Flamingo ..... E01F 9/688 116/63 C
7,244,219 B1 * 7/2007 Preciado ..... A63B 69/24 482/83
7,651,447 B2 * 1/2010 Yang ..... A63B 69/0075 482/82
7,677,831 B2 * 3/2010 Kulp ..... E01F 9/688 116/63 C
9,254,415 B2 * 2/2016 Ha ..... A63B 23/03508
2004/0083943 A1 * 5/2004 Huang ..... E01F 9/688 116/63 C
2004/0112389 A1 * 6/2004 Abraham ..... A63B 71/085 128/859
2004/0237875 A1 * 12/2004 Garcia ..... E01F 9/688 116/63 C
2005/0076822 A1 * 4/2005 Levine ..... E01F 9/688 116/63 C
2006/0016383 A1 * 1/2006 Flamingo ..... E01F 9/688 116/63 C
2006/0270534 A1 * 11/2006 Adcock ..... A63B 21/00185 482/128
2007/0282362 A1 * 12/2007 Berg ..... A61B 5/150022 606/181
2008/0216348 A1 * 9/2008 Kwon ..... A43B 13/182 36/27
2009/0082176 A1 * 3/2009 Watterson ..... A63B 22/02 482/54
2009/0318269 A1 * 12/2009 D'Addario ..... A63B 21/023 482/47
2010/0058616 A1 * 3/2010 Ryoo ..... A43B 13/182 36/102
2011/0271864 A1 * 11/2011 Rastegar ..... F42B 10/44 102/517
2012/0214650 A1 * 8/2012 Jahns ..... A63B 21/0004 482/111
2012/0283069 A1 * 11/2012 Martin ..... A63B 21/023 482/11
2014/0162852 A1 * 6/2014 Ho ..... A63B 21/023 482/127
2014/0352810 A1 * 12/2014 Wedi ..... E03F 5/04 137/362
2015/0246261 A1 * 9/2015 Chen ..... A63B 21/068 482/141
2015/0352397 A1 * 12/2015 Essapen ..... A63B 21/05 482/128
2016/0144227 A1 * 5/2016 Bell ..... A63B 23/032 482/11
2016/0228740 A1 * 8/2016 Castelluccio ..... A63B 23/0211
2017/0136205 A1 * 5/2017 Rusher ..... A61M 16/208

* cited by examiner

PHYSICAL THERAPY ASSISTANCE DEVICE

CROSS-REFERENCE TO RELATED APPLICATION

The present application claims priority to U.S. Provisional Patent Application Ser. No. 62/549,341 entitled "PERIPHERAL EXTREMITY APPLICATION AND PROPRIOCEPTION SYSTEM," filed on Aug. 23, 2017, the contents of which is hereby incorporated by reference in its entirety as if fully set forth herein.

FIELD OF THE DISCLOSURE

The present disclosure relates generally to a physical therapy device. More Specifically, the present disclosure related to a device for rehabilitating patients that is capable of improving balance and stability, and methods of manufacture and use of the device.

BACKGROUND OF THE DISCLOSURE

Physical therapy can be a difficult process for patients recovering from injuries and/or accidents. While licensed and trained physical therapists can assist heavily in the process of rehabilitation, new techniques and products may assist in patient recovery. Specifically, small devices that require minimal physical therapist oversight, and that can allow a patient to perform exercises independently would be helpful. Such devices may allow the patient to perform exercises in a physical therapy office setting or at home.

The present disclosure relates to a physical therapy device that assists the user in rehabilitating their feet and hands. The present disclosure will allow patients to work on balance and stability of the peripheral extremities, such as the foot and hands, without the assistance of a physical therapist or another person. Additionally, the present disclosure relates to small devices that are easily transportable, and that can be easily modified to increase or decrease the level of difficulty for different patients.

SUMMARY OF THE DISCLOSURE

In some embodiments, a physical therapy assistance device includes a base having a non-slip portion, a spring extending between a first end and a second end and having a first height in a fully expanded condition and a partially compressed condition, the spring being coupled to the base at the first end, and a cone extending between a first end having a first diameter, and a second end having a second diameter, the cone having a cone height, and at least partially housing the spring therein so that in the fully expanded condition of the spring, the first height of the spring is larger than the cone height.

BRIEF DESCRIPTION OF THE DISCLOSURE

Various embodiments of the presently disclosed connectors are disclosed herein with reference to the drawings, wherein.

Various embodiments of the present invention will now be described with reference to the appended drawings. It is to be appreciated that these drawings depict only some embodiments of the invention and are therefore not, to be considered limiting of its scope.

DETAILED DESCRIPTION

Despite the various improvements that have been made to physical therapy devices, conventional methods suffer from some shortcomings as discussed above.

There therefore is a need for further improvements to the devices and methods used to help the rehabilitation, balance, and/or stability of patients. Among other advantages, the present disclosure may address one or more of these needs.

Figure 1A:
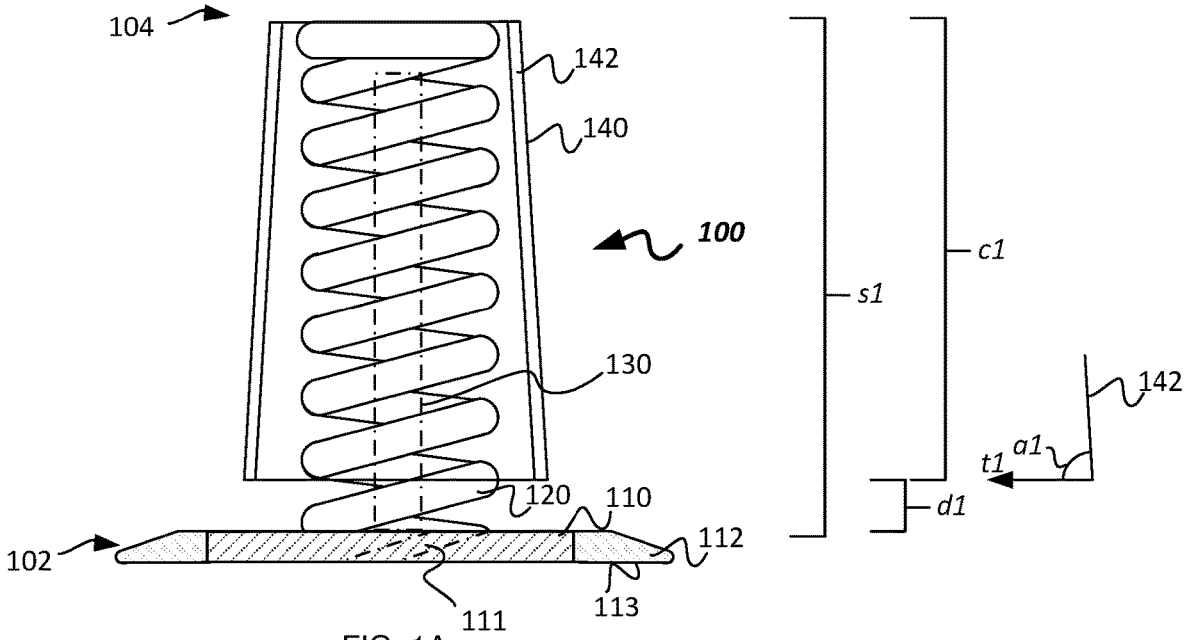
FIG. 1A is a schematic cross-sectional view of a physical therapy assist device according to one embodiment.

FIG. 1A illustrates a physical therapy assistance device 100 extending between a proximal end 102 and a distal end 104, the device generally having a base 110, a spring 120 and a therapy cone 140. The device 100 is shown in the expanded state in FIG. 1A, and in the compressed state in FIG. 1B.

Figure 1B:
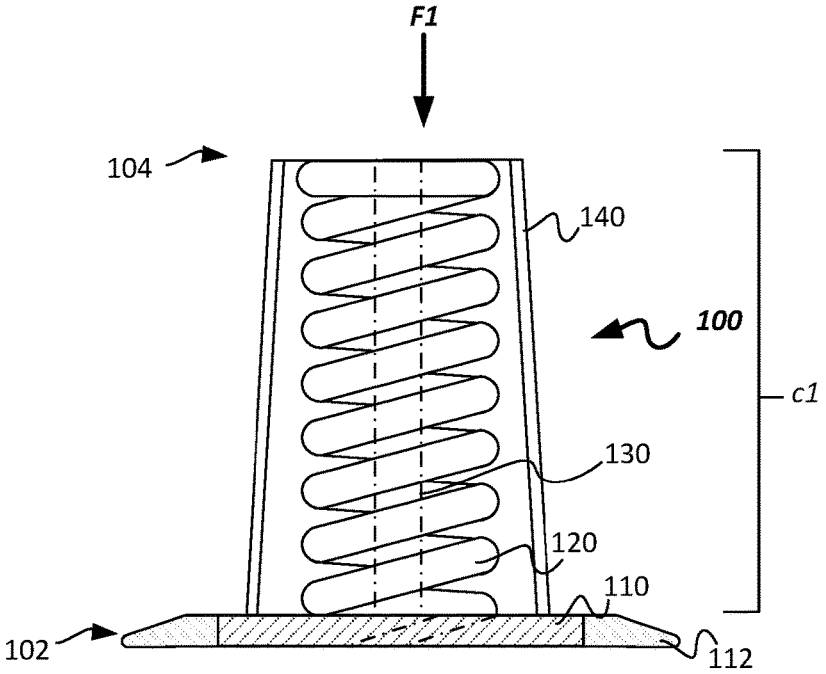
FIG. 1B is a schematic cross-sectional view of the physical therapy assist device of FIG. 1A in the compressed state.
Figure 1C:
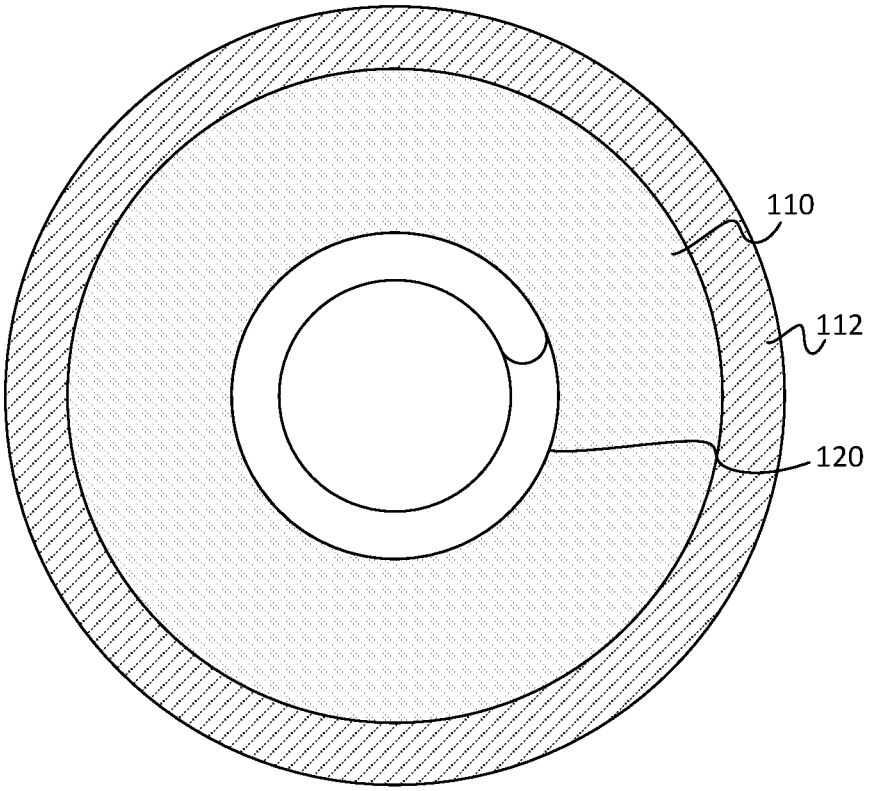
FIG. 1C is a schematic top view of the physical therapy assist device of FIG. 1A without the cone.
Figure 1D:
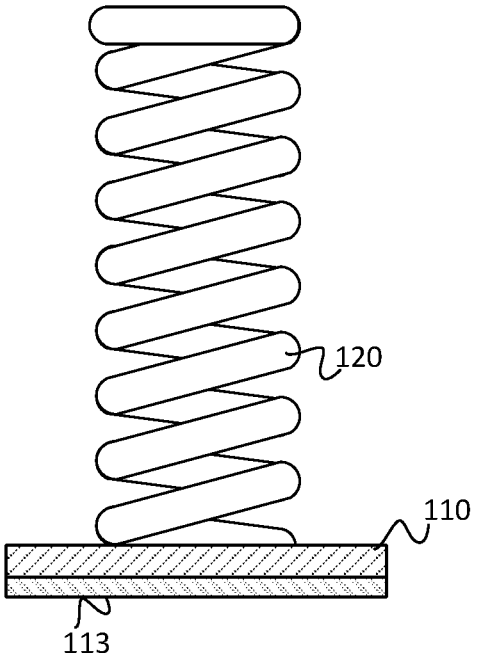
FIG. 1D is a schematic side view of another example of a spring coupled to a base.

Base 110 may be formed of a rigid, semi-rigid, or flexible material capable of supporting the spring and cone. In at least some examples, base 110 may be formed of a metal, a plastic, wood, dense rubber or other suitable combination of materials. Base 110 may be generally circular (FIG. 1C), and may include a receptacle 111 for receiving and coupling to one end of a spring. Optionally, an outer ring 112 of material is coupled to base 110. Outer ring 112 may be formed of a rubber, a plastisol product, a silicone product, non-slip polymers, softex grip substance or suitable combination of materials, and may be configured so as to include a non-slip surface 113 having a coefficient of friction that is greater than that of base 110 to prevent the base from sliding when being used by a patient. In at least some examples, base 110 may be partially or completely formed of the same material as outer ring 112. Alternatively, instead of forming an outer ring, the material of the non-slip portion may instead be coupled to the lower end of base 110 so that a two-layered base is formed including the rigid portion and the non-slip surface as shown in FIG. 1D.

Turning back to FIG. 1A, spring 120 is coupled to base 110 via receptacle 111 or other suitable means on one end, and may extend longitudinally away from the upper surface of base 110. Spring 120 may include a number of windings, and may have a spring height "s1" of between 8 and 13 inches in the fully expanded state (e.g., when no force is exerted on one end of the spring). In one example, a spring may be formed of MusicWire. It will be understood that other materials may be used for the spring, and that the spring may be oil tempered, hard drawn, stainless, chrome silicon, beryllium copper and phosphor bronze. In at least some embodiments, height "s1" may be equal to the height "c1" of cone 140 plus an additional distance "d1" which is the distance between the bottom of the cone and the upper surface of base 110 (i.e., s1=c1+d1).

In at least some examples, spring 120 may have a thickness of between 0.1 and 0.4 inches. It will be understood that the thicker the spring, the more difficult it will be to compress it. Thus, a thinner spring may be initially used during rehabilitation, and devices with thicker springs may be progressively used as the patient's rehabilitation continues, increasing the level of difficulty. In at least some examples, the spring 120 may be selected from springs divided into a number of groupings, such as for example, three groupings. The three groupings may include "novice," "intermediate," and "difficult." The spring constant K1 of the novice spring may be between 5.0 and 100.0. The spring constant K2 of the intermediate spring may be between 100.0 and 250.0. The spring constant K3 of the difficult spring may be between 250.0 and 500.0. Thus, devices may be formed having different degrees of difficulty based on the spring constant of the selected spring.

The diameter of spring 120 may also be modified as necessary. In at least some examples, the diameter of spring 120 may be between 1.25 and 2.0 inches, which is small enough to fit within the top of cone 140.

Figure 1E:
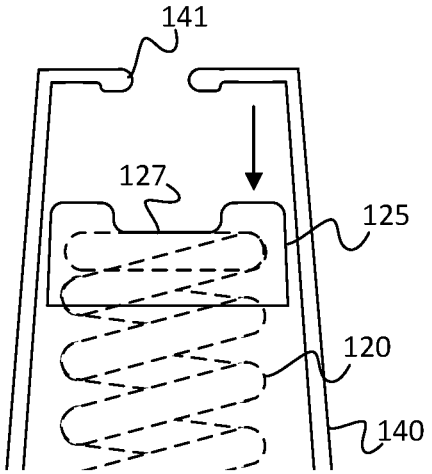
FIG. 1E is a schematic partial view of the top of a cone and the spring.

In at least some examples, cone 140 may include a peripheral lip 141 that extends from a top surface of the cone down toward the interior of the cone, and spring 120 may include an option cap 125 as shown in FIG. 1E. Cap 125 may be formed of a metal, wood, a plastic or any other polymer or suitable combination of materials, and may be generally cone-shaped have a width that is slightly larger than the width of the top of a spring. Cap 125 may also have a recess 127 that is configured and arranged to accept and mate with the peripheral lip 141 of cone 140 so that the cone is stabilized over the cap. In addition to providing a larger flat surface on which cone 140 will rest, cap 125 may also be used to prevent injury from spring 120. Cap 125 may be affixed to spring 120, and spring 120 including cap 125 may be separable from cone 140 so that different cones may be used as desired. Alternatively, spring 120 and/or cap 125 may be directly adhered, affixed or attached, or otherwise coupled to the inside of cone 140.

Figure 1F:
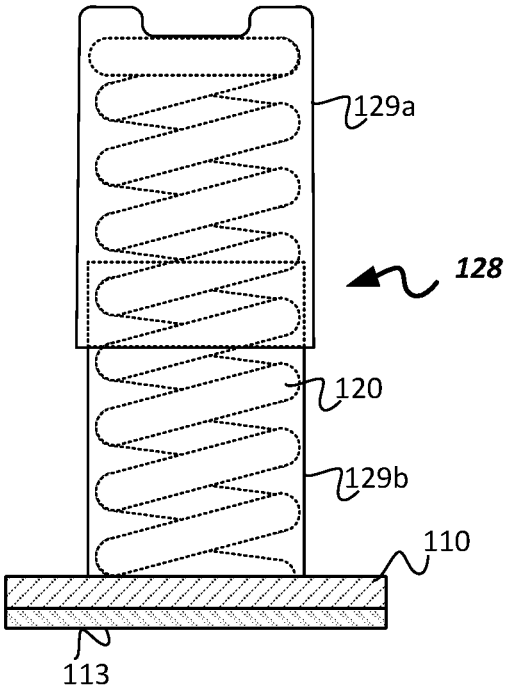
FIG. 1F is a schematic cross-sectional view of a spring disposed within an optional housing.

In one embodiment, instead of a simple cap, a housing may be formed around the spring 120 as shown in FIG. 1F. Housing 128 may prevent the spring from being exposed to the air and the elements. In at least some examples, housing 126 includes an upper portion 129*a* and a lower port 129*b* that fits within upper portion 129*a*, the two portions being moveable relative to one another so that they do not prevent the spring from compressing properly.

An optional shaft 130 may be disposed inside the windings of spring 120 to aid in stabilizing the spring. Shaft 130 may be coupled to base 110 as shown, and may have a height equal to or less than the height of the cone "c1," so that when the device is compressed, the shaft 130 does not protrude or extend upward further than the cone 140.

Cone 140 may be formed and configured in the shape of a typical physical therapy cone, and may have a height "c1" of between six and eight inches. Cone 140 may generally have a circumference of between 3.5 and 6.0 inches on top, and a base circumference of between 5.5 and 8.5 inches. Additionally, cone 140 may have a sidewall 142 that slopes at a degree a1 of 86.0 with respect to the transverse axis t1.

As discussed above, device 100 may include springs of different spring constants, and thus, stiffnesses, and devices may be divided in categories of novice, intermediate and difficult based on the spring constant. Additionally, the cones may be colored to indicate the difficulty of the device. For example, a device having a relatively small spring constant may have a green colored cone, a device having an "intermediate" spring constant may have a blue colored cone, and a device having a relatively large spring constant may have a black colored cone. Thus, the difficulty level of the device may be quickly identified by cone color without having to test the device.

To use the device 100, the user may place his hand on the top of the cone 140 and apply a force F1 to compress the spring 120. As the spring compresses, the cone 140 may travel toward the base 110 until it contacts the base. The user may then release the cone so that the spring causes it to return to its expanded state. Thus, one repetition of the exercise is completed, and the user may continue to perform a predetermined number of repetitions as a part of their physical therapy. It will be understood that instead of using his hand, a user may instead step on the cone and perform repetitions with their lower body. In this manner, the user may use the device to improve joint stability and rehabilitate said joints, as well as to strengthen key dexterity muscles. For example, muscles responsible for fine motor skills and/or dexterity, such as peroneals muscle and posterior tibialis, which stabilize the ankle may be exercised. FIG. 1B shows the device in the compressed state after a force F1 has been applied.

It will be understood that instead of a metallic coil spring, other analogous mechanisms may be used. For example, an air suspension system may be used. Thus, as shown, a device may include a base, an outer ring, a cone and an air suspension mechanism having a piston disposed within a gas-filled compartment. Though the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

It will be appreciated that the various dependent claims and the features set forth therein can be combined in different ways than presented in the initial claims. It will also be appreciated that the features described in connection with individual embodiments may be shared with others of the described embodiments.

What is claimed is:

1. A physical therapy assistance device comprising:

a base having a non-slip portion;

a spring extending between a first end and a second end and having a first height in a fully expanded condition and a partially compressed condition, the spring being coupled to the base at the first end;

a cone extending between a first end having a first diameter, and a second end having a second diameter, the cone having a peripheral lip and a cone height, and at least partially housing the spring therein so that in the fully expanded condition of the spring, the first height of the spring is larger than the cone height; and a cap disposed over a portion of the spring, the cap having a recess for mating with the peripheral lip of the cone.

2. The physical therapy assistance device of claim 1, wherein the first height of the spring is between eight and thirteen inches.

3. The physical therapy assistance device of claim 1, wherein the spring includes a metallic member that is coiled, the metallic member having a thickness of between 0.1 and 0.4 inches.

4. The physical therapy assistance device of claim 1, wherein the base is cylindrical, and the non-slip portion is formed as an outer ring on a periphery of the base.

5. The physical therapy assistance device of claim 1, wherein the base is cylindrical, and the non-slip portion is formed as a secondary layer applied to a bottom of the base.

6. The physical therapy assistance device of claim 1, wherein the base defines a receptacle for receiving a portion of the spring.

7. The physical therapy assistance device of claim 1, wherein in the fully expanded condition, the cone is spaced from the base by a distance of between two and four inches.

8. A physical therapy assistance device comprising:

a base having a non-slip portion;

a spring extending between a first end and a second end and having a first height in a fully expanded condition and a partially compressed condition, the spring being coupled to the base at the first end;

a cone extending between a first end having a first diameter, and a second end having a second diameter, the cone having a cone height, and at least partially housing the spring therein so that in the fully expanded condition of the spring, the first height of the spring is larger than the cone height; and a shaft disposed within the spring, the shaft having a shaft height that is equal to or less than the cone height.

9. A method of manufacturing a physical therapy device comprising:

providing a base having a non-slip portion;

coupling the base to a spring that extend between a first end and a second end and having a first height in a fully expanded condition and a partially compressed condition, the spring being coupled to the base at the first end; and placing a cone over the spring, the cone extending between a first end having a first diameter, and a second end having a second diameter, the cone having a cone height, and at least partially housing the spring therein so that in the fully expanded condition of the spring, the first height of the spring is larger than the cone height; and placing a cap on the second end of the spring, the cap having a central recess capable of mating with a portion of the cone.

10. The method of claim 9, wherein the spring has a length of between eight and thirteen inches.

* * * * *